US005255858A

United States Patent [19]

Usami

[11] Patent Number: 5,255,858

[45] Date of Patent: Oct. 26, 1993

[54] MILLING METHOD AND MILLING DEVICE

[76] Inventor: Morikazu Usami, 140, Hinode-cho, Fuji-shi, Shizuoka-ken, Japan

[21] Appl. No.: 684,052

[22] Filed: Apr. 11, 1991

[30] Foreign Application Priority Data

Aug. 30, 1990 [JP] Japan ..... 2-228956

[51] Int. Cl.[5] ..... B02C 19/06

[52] U.S. Cl. ..... 241/5; 241/39; 241/26; 241/60; 241/172; 241/284; 241/6

[58] Field of Search ..... 241/5, 39, 46.17, 284, 241/26, 6, 12, 21, 60, 172

[56] References Cited

U.S. PATENT DOCUMENTS

| | | | |
|---|---|---|---|
| 498,037 | 5/1893 | Sturtevant | 241/284 X |
| 1,282,181 | 10/1918 | Brantingham | 241/284 |
| 1,441,162 | 1/1923 | MacCartney et al. | 241/26 |
| 1,798,886 | 3/1931 | Kramer | 241/284 X |
| 1,814,587 | 7/1931 | Daniels | 241/261.2 |
| 2,968,444 | 1/1961 | Jones | 241/261.2 X |
| 4,511,092 | 4/1985 | North et al. | 241/172 X |

*Primary Examiner*—Mark Rosenbaum
*Assistant Examiner*—Kenneth J. Hansen
*Attorney, Agent, or Firm*—Darby & Darby

[57] ABSTRACT

A milling method for pulverizing agricultural products, minerals, etc. comprises the steps of whirling a grain material within a pulverizing chamber; and pulverizing the material by utilizing the friction due to a difference in moving speed between material particles which is generated as the material is whirled. A milling device comprises: a body frame; first and second rotary blades arranged opposite to each other within the body frame and defining, together with the inner walls of the body frame, a pulverizing chamber; a material feeding inlet formed on the body frame on the side of the first rotary blade and communicating with the pulverizing chamber; and a collection outlet provided axially in alignment with the second rotary blade and communicating with the pulverizing chamber. The collection outlet communicates with an associated suction device.

5 Claims, 1 Drawing Sheet

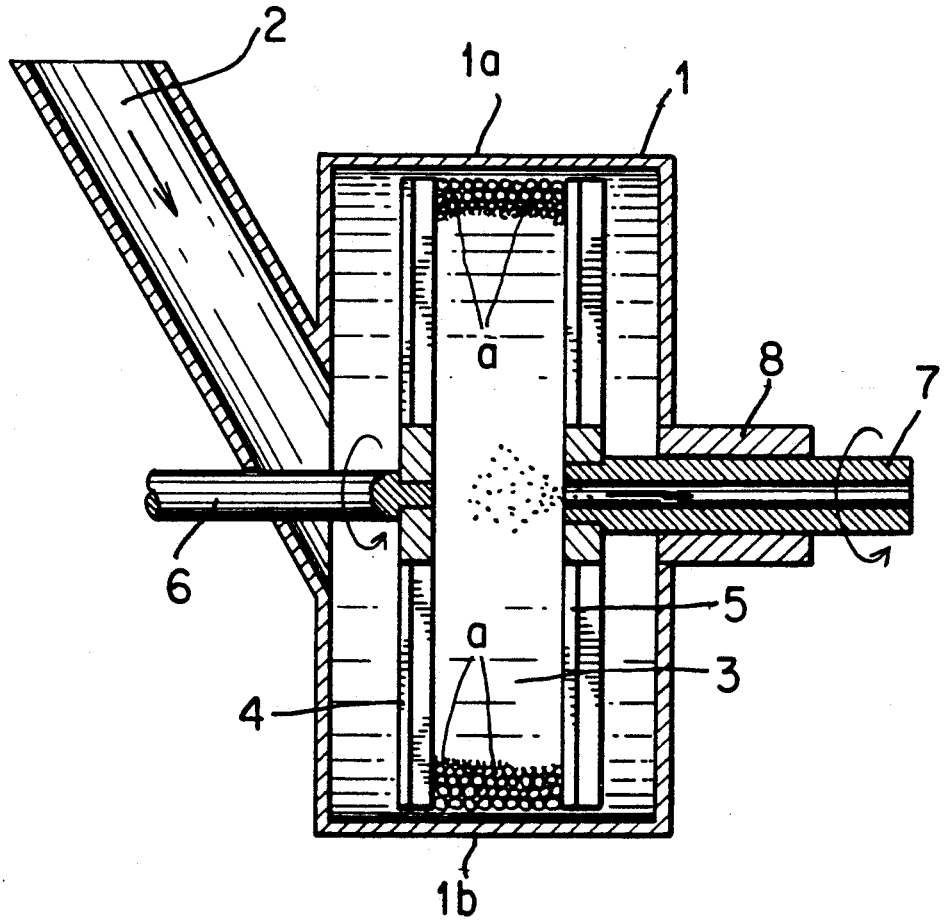
2
1a
1
a
8
7
6
5
a
3
4
1b

MILLING METHOD AND MILLING DEVICE

BACKGROUND OF THE INVENTION

1. Field of the Invention

This invention relates to a milling method for pulverizing agricultural products, minerals, etc.

2. Description of the Related Art

Conventionally, the pulverization of agricultural products, in particular, cereals, has been performed by using a pulverizer called a mill, such as a ball mill, a vibrating mill, or a hammer mill.

The conventional milling method using such a mill requires the consumption of a large amount of energy and time for pulverization. Accordingly, the method is rather poor in terms of pulverization efficiency. Furthermore, the conventional method is limited in terms of processing capacity.

Moreover, the grain size distribution in the pulverized object is substantially determined by the mill used and is very difficult to change.

Further, the principal members of a mill, e.g., the balls, are extremely liable to wear. In addition, there is a problem that foreign matter generated as a result of wear may enter the pulverizer.

SUMMARY OF THE INVENTION

The present invention has been made with a view to eliminating the above problems in the conventional milling method using a mill. It is accordingly an object of this invention to provide a milling method and a milling device which provide a level of high pulverization efficiency, which allow an arbitrary setting of grain size distribution, and which help to avoid foreign matter intrusion into the pulverized object so that a high quality product can be obtained.

BRIEF DESCRIPTION OF THE DRAWINGS

The accompanying drawing show a sectional view of a device in accordance with an embodiment of this invention.

DETAILED DESCRIPTION OF THE PREFERRED EMBODIMENT

The present invention will now be described with reference to the drawing.

The device shown includes a body frame 1 equipped with a feeding inlet 2. The body frame 1 contains a first rotary blade 4 and a second rotary blade 5 which is opposed thereto. These rotary blades 4 and 5 define, together with upper and lower walls 1*a* and 1*b* of the body frame 1, a pulverizing chamber 3.

The first rotary blade 4, which is positioned inside the body frame 1 on the side of the feeding inlet 2, has at its center a drive shaft 6, which extends to the exterior of the body frame 1 to be joined to a driving device (not shown). The configuration of this first rotary blade 4 is so determined as to help introduce grain material supplied through the feeding inlet 2 into the pulverizing chamber 3 and to impart a whirling motion to the air in the body frame 1, i.e., in the pulverizing chamber 3.

The second rotary blade 5 has substantially the same configuration as the first rotary blade 4 and is equipped, at its center, with a drive barrel 7 which is in alignment with the drive shaft 6. This drive barrel 7 is slidably supported by a sleeve 8 provided on the body frame 1 and is joined to a driving device (not shown), so that the second rotary blade 5 can move toward and away from the first rotary blade 4, with the pulverizing chamber 3 communicating through this drive barrel 7 with a suction device (not shown).

When rotated by their respective rotating devices through the drive shaft 6 and the drive barrel 7, respectively, the rotary blades 4 and 5 impart a whirling motion to the air in the pulverizing chamber 3, thereby generating a vortex in the chamber.

The material a, fed in the above condition through the feeding inlet 2 into the body frame 1, is conveyed by the first rotary blade 4 into the pulverizing chamber 3, where it is moved around by the action of the vortex. In this process, a difference in speed is generated between the portion of the material in the central section of the vortex and that in the outer section of the vortex. This difference in speed causes friction between the material grains, thereby pulverizing the material.

When the suction device (not shown) is operated in this condition, the pulverized material, which is not so much under the influence of the centrifugal force generated by the vortex as it is under the influence of the sucking force of this suction device, is collected through the drive barrel 7.

By appropriately setting the correlation among the centrifugal force due to the vortex, the sucking force of the suction device, and the weight of the material particles, the device of this embodiment can help to obtain a fine powder with a substantially uniform grain size.

The degree of uniformity in grain size required depends on how the pulverized object is to be used. Generally speaking, a uniform fine powder can be obtained with this device as long as the material is such that it can be moved around by the air vortex generated in the pulverizing chamber 3.

The medium for whirling the material does not necessarily have to be air. It may also be a liquid such as water.

It is to be assumed that the difference in moving speed between different material portions, which is generated as the material is whirled, may be of different types, i.e., it may be a difference in speed in the radial, tangential, or axial direction of the vortex. While in the device of the above embodiment the difference in speed in the tangential direction of the vortex is utilized, it goes without saying that the difference in speed in any one of the above three directions may be utilized. It is also possible to obtain a pulverized product by operating the rotary blades after the material has been supplied into the pulverizing chamber, instead of operating the blades while the material is being supplied.

As a concrete example, a milling device was prepared, in which the diameter of the first and second rotary blades 4 and 5 was 250 mm; the distance between the blades was 40 mm; the rotating speed of the blades was 4500 rpm; and the inner diameter of the drive barrel 7 was 100 mm. Further, the sucking speed of the associated suction device was 10 m/s. By successively supplying wheat into the pulverizing chamber 3 of this milling device at a rate of 1 kg per minute, a pulverized product with an average grain size of 20 $\mu$m was collected.

In accordance with this invention, a material is whirled so as to generate a difference in moving speed between material portions, and this difference in moving speed causes friction between the material portions, thereby pulverizing the material. Thus, this invention provides a milling method which excels in pulverization efficiency and which allows arbitrary setting of grain size distribution, and a milling device which is economical in terms of energy consumption for pulverization and which avoid foreign matter intrusion.

What is claimed is:

1. A milling device comprising:

a body frame;

first and second rotary blades arranged opposite to each other within said body frame and defining, together with the inner walls of said body frame, a single pulverizing chamber;

a material feeding inlet formed on said body frame on a side of said first rotary blade and communicating with said pulverizing chamber;

and a collection outlet provided through and in axial alignment with said second rotary blade communicating directly with said pulverizing chamber, said collection outlet communicating with a suction device, whereby material having a predetermined, substantially uniform, grain size is extracted.

2. A milling device, comprising:

a body frame;

first and second rotary blades arranged opposite to each other within said body frame and defining, together with the inner walls of said body frame, a pulverizing chamber, wherein said second rotary blade can move toward and away from said first rotary blade;

a material feeding inlet formed on said body frame on a side of said first rotary blade and communicating with said pulverizing chamber;

and a collection outlet provided axially in alignment with said rotary blade and communicating with said pulverizing chamber, said collection outlet communicating with a suction device, whereby material having a predetermined, substantially uniform, grain size, is extracted.

3. A milling device comprising:

a body frame;

first and second rotary blades arranged opposite to each other within said body frame and defining, together with the inner walls of said body frame, a pulverizing chamber said second rotary blade being adapted to move toward and away from said first rotary blade;

a material feeding inlet formed on said body frame on a side of said first rotary blade and communicating with said pulverizing chamber; and a collection outlet provided axially in alignment with said second rotary blade and communicating with said pulverizing chamber, said collection outlet communicating with a suction device, whereby material having a predetermined, substantially uniform, grain size are extracted.

4. A milling method comprising the steps of:

whirling a grain material within a pulverizing chamber to create rotation of the material about an axis of rotation;

pulverizing said material by utilizing a difference in moving speed between material particles which is generated as said material is whirled; and creating a vacuum along the axis of rotation to extract material haivng predetermined, substantially uniform, grain size.

5. A milling method comprising the steps of:

whirling a grain material within a pulverizing chamber, said pulverizing chamber in part defined by first and second rotary blades, to create rotation of the material about an axis of rotation;

establishing an optimum pulverizing spacing between said first and said second rotary blades; and pulverizing said material by utilizing a difference in moving speed between material particles which is generated as said material is whirled; and creating a vacuum along the axis of rotation to extract material having predetermined, substantially uniform, grain size.

* * * * *